US008381522B2

(12) United States Patent
Hansen, Jr.

(10) Patent No.: US 8,381,522 B2
(45) Date of Patent: Feb. 26, 2013

(54) STEAM POWERED ENGINE

(76) Inventor: Christian Hansen, Jr., Jacksonville, FL (US)

( * ) Notice: Subject to any disclaimer, the term of this patent is extended or adjusted under 35 U.S.C. 154(b) by 1330 days.

(21) Appl. No.: 11/799,604

(22) Filed: May 2, 2007

(65) Prior Publication Data

US 2008/0271454 A1 Nov. 6, 2008

(51) Int. Cl.
*F02G 3/00* (2006.01)

(52) U.S. Cl. ..... 60/616; 60/618; 60/620

(58) Field of Classification Search ..... 60/614–620, 60/513

See application file for complete search history.

(56) References Cited

U.S. PATENT DOCUMENTS

| | | | | |
|---|---|---|---|---|
| 1,233,951 | A | | 7/1917 | Alder |
| 1,424,798 | A | | 8/1922 | Black |
| 1,682,307 | A | | 8/1928 | Porter |
| 2,791,881 | A | | 5/1957 | Denker |
| 3,074,228 | A | * | 1/1963 | Lee ..... 123/22 |
| 3,192,705 | A | | 7/1965 | Miller |
| 3,336,746 | A | | 8/1967 | Southwick |
| 4,102,130 | A | | 7/1978 | Stricklin |
| 4,151,814 | A | | 5/1979 | Doieg |
| 4,393,653 | A | | 7/1983 | Fischer |
| 4,408,573 | A | | 10/1983 | Schlueter et al. |
| 5,875,633 | A | * | 3/1999 | Lawson, Jr. ..... 60/618 |
| 6,095,100 | A | | 8/2000 | Hughes |
| 6,272,855 | B1 | * | 8/2001 | Leonardi ..... 60/513 |
| 6,282,900 | B1 | * | 9/2001 | Bell ..... 60/648 |

* cited by examiner

*Primary Examiner* — Hoang Nguyen
(74) *Attorney, Agent, or Firm* — Thomas C. Saitta

(57) ABSTRACT

A steam powered engine system wherein hot exhaust gas produced by a small secondary engine is used to heat water to a temperature above 212 degrees F., the superheated water being injected into a cylinder containing hot compressed gas. The water then flash expands into steam to drive a piston. The hot exhaust gas from the secondary engine is further utilized to scavenge spent gas and liquid from the cylinder during the return stroke of the piston, as well as to maintain a suitably high temperature within the cylinder.

20 Claims, 3 Drawing Sheets

STEAM POWERED ENGINE

BACKGROUND OF THE INVENTION

This invention relates generally to the field of combustion engines, and more particularly to the field of steam-powered engines. Even more particularly, the invention relates to boilerless engines wherein exhaust gas, and the heat contained therein, produced by a small, secondary gasoline or diesel engine is utilized in the operation of the main engine.

Steam powered engines, often characterized as a type of external combustion engine, are well known, and typically comprise a boiler wherein steam is produced. Such systems are relatively inefficient and have not proven suitable as a means to provide the power source for vehicles and the like.

Examples of early attempts to provide an efficient steam powered engine, all of which show devices with significant differences to the invention at hand, include U.S. Pat. No. 1,233,951, issued to Alder in 1917, U.S. Pat. No. 1,424,798, issued to Black in 1922, U.S. Pat. No. 1,682,307, issued to Porter in 1928, U.S. Pat. No. 2,791,881, issued to Denker in 1957, U.S. Pat. No. 3,074,228, issued to Lee in 1963, U.S. Pat. No. 3,192,705, issued to Miller in 1965, U.S. Pat. No. 3,336,746, issued to Southwick in 1967, U.S. Pat. No. 4,102,130, issued to Stricklin in 1978, U.S. Pat. No. 4,151,814, issued to Doieg in 1979, U.S. Pat. No. 4,393,653, issued to Fischer in 1983, U.S. Pat. No. 4,408,573, issued to Schlueter et al. in 1983, and U.S. Pat. No. 6,095,100 issued to Hughes in 2000.

It has been discovered that an efficient steam powered engine can be produced as part of a system comprising a main engine, used to power a vehicle or other equipment, and a secondary internal combustion engine.

SUMMARY OF THE INVENTION

The invention is a steam powered engine system or assembly comprising a main engine used to deliver power to a vehicle or other piece of operational equipment in combination with a small, fuel-efficient, secondary, internal combustion engine powered by gasoline, diesel fuel or the like. The secondary engine provides hot exhaust gas that is utilized in multiple ways. The exhaust gas from the secondary engine is used to heat water to a temperature greater than 212 degrees F. for delivery or injection into the cylinder of the main engine. The exhaust gas is also utilized as a scavenging gas by delivering the exhaust gas into the cylinder of the main engine during the up or non-power stroke of the piston. The exhaust gas is also used to provide the necessary heat to maintain the internal temperature of the cylinder above the minimum temperature necessary for flash conversion of the hot water into steam to drive the piston. The exhaust gas may be routed into the main engine cylinder through ports exposed only when the piston is near the bottom of the down stroke, or may be routed into the main engine cylinder through one or more valves located in the upper portion of the main engine cylinder. A heat exchanger is used to transfer heat from the exhaust gas to the water. Gas turbines, blowers or similar means may be utilized to force the exhaust gas into the main engine cylinder and/or to suction the spent gas from the main engine cylinder. In alternative embodiments, the main cylinder may be provided with internal heating means, such as by providing a glow plug or resistance element, which may be electrically powered by a generator acting in combination with the secondary engine, or by routing the exhaust gas line from the secondary engine through the interior of the main engine cylinder. In alternative embodiments, the secondary engine may be replaced with a hot gas source, such as the combination of a gas flame with a blower.

DETAILED DESCRIPTION OF THE INVENTION

The steam powered engine comprises a system of interrelated components, and various embodiments are presented.

Figure 3:
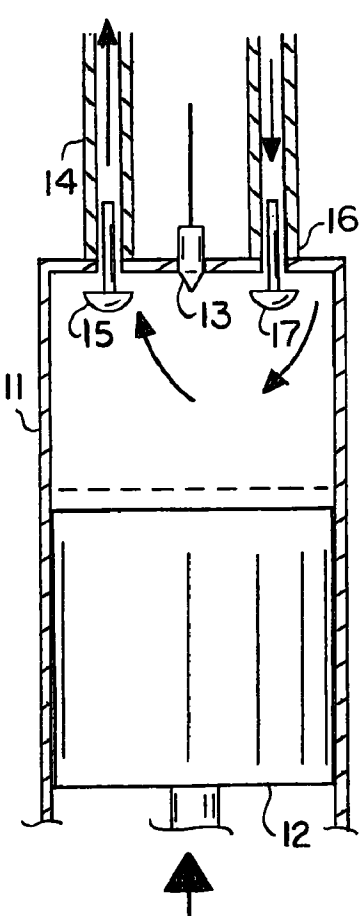
FIG. 3 is a representational view of a portion of FIG. 1, shown with the piston nearing the halfway point of the up stroke.
Figure 2:
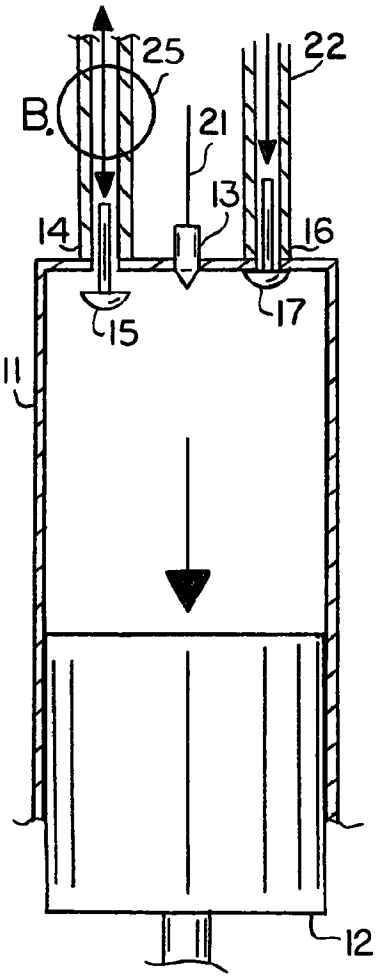
FIG. 2 is a representational view of a portion of FIG. 1, shown with the piston at the bottom of the down stroke.
Figure 1:
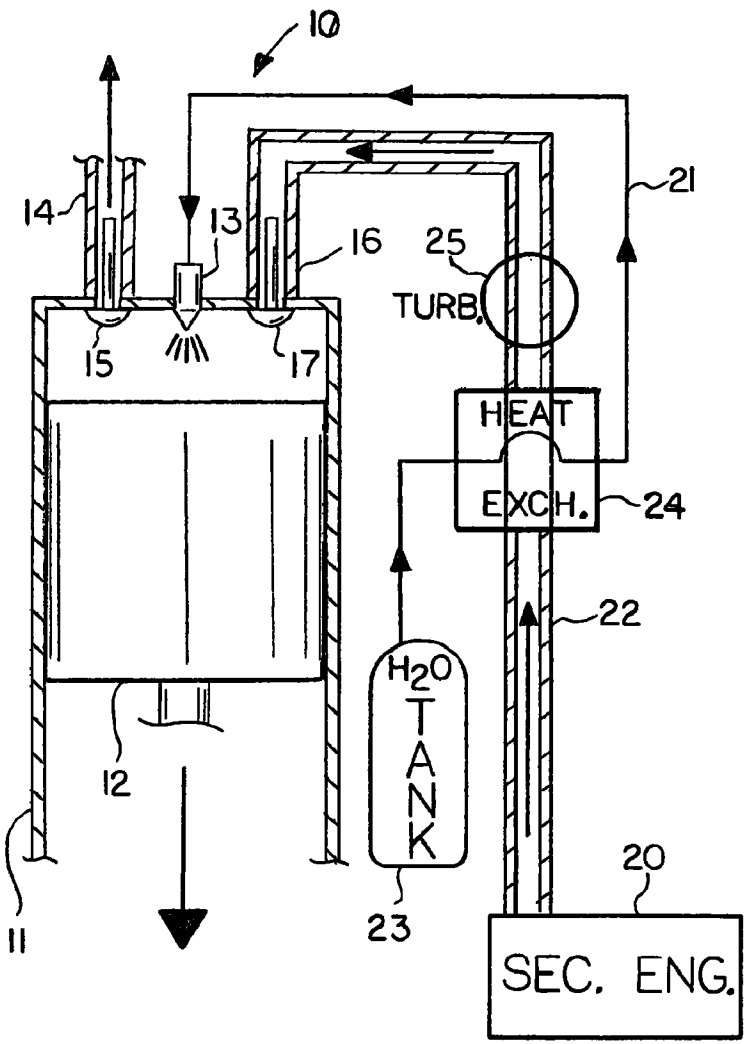
FIG. 1 is a representational view of an embodiment of the steam powered engine, shown with the piston at the initiation of the down stroke.

As shown in FIGS. 1 through 3, in one embodiment the steam powered engine is a system comprising a main engine 10 comprising a cylinder 11 and a piston 12, the piston 12 reciprocating within the cylinder 11 in known manner in order to power a drive shaft, cam shaft or the like for operation of a motor vehicle or piece of power equipment, for example. The cylinder 11 is provided with an exhaust port 14, the exhaust port 14 being controlled by an exhaust valve 15 such that at times passage of exhaust gases from the cylinder 11 is permitted, while at other times passage is precluded. The cylinder 11 is also provided with a scavenger port 16 that is controlled by a scavenger valve 17, whereby at times hot exhaust gas produced by a secondary engine 20 of relatively low horsepower is allowed to pass into the cylinder 11, while at other times passage of the hot gasses is precluded. The cylinder 11 is further provided with a hot water injection nozzle 13, whereby a metered portion of super-heated water—water having a temperature in excess of 212 degrees F.—may be introduced into the cylinder 11.

The water is drawn from a tank 23 containing water at ambient temperature, or at a slightly elevated temperature due to absorption of heat from the engine, and travels through a water conduit 21, passing through a heat exchanger 24 prior to its introduction into the cylinder 11. The heat source for the heat exchanger 24 is the exhaust gas produced by a secondary engine 20, the exhaust gas having a temperature in excess of 1000 degrees F. The hot exhaust gas is routed through a hot gas conduit 22 into the heat exchanger 24, where heat is transferred to the water from the tank 23 to raise the water temperature to above 212 degrees F. The hot gases, now at a slightly reduced temperature, continue through the heat exchanger 24 to be delivered to the cylinder 11 when needed. The secondary engine 20 may comprise a standard gasoline or diesel powered engine of relatively low horsepower, such that the secondary engine 20 alone is insufficient to provide sufficient power to drive the vehicle or equipment to be powered by the main engine 10, but may be used to provide energy to other systems.

Blower means 25, such as for example gas turbines, blowers or other devices capable of forcing or suctioning may be utilized to move the hot exhaust gas through the conduit 22, to introduce the hot exhaust gas into the cylinder 11, or to remove the gas from the cylinder 11 during scavenging. Any excess exhaust gas produced by the secondary engine 20 is vented to atmosphere.

The operation of the steam powered engine system is demonstrated with reference to FIGS. 1, 2 and 3. In FIG. 1, a metered amount of super-heated water at a temperature in excess of 212 degrees F. is injected into the hot, compressed gas in the top of the cylinder 11. The super-heated water immediately expands into steam, driving the piston 12 downward. As the piston 12 reaches the bottom of the down or power stroke, the exhaust valve 15 opens to relieve pressure within the cylinder 11, as illustrated in FIG. 2. As the piston 12 begins its up or return stroke, the scavenger valve 17 also opens, allowing hot exhaust gas from the secondary engine 20 to enter the cylinder 11. This assists in flushing out through the exhaust port 14 the gas and liquid present in the cylinder 11, as shown in FIG. 3. When the piston 12 reaches approximately halfway, as indicated by the dashed line, the scavenger valve 17 and the exhaust valve 15 both close, such that the hot gas remaining in the cylinder 11 is compressed. The cycle then repeats.

Figures 4, 5:
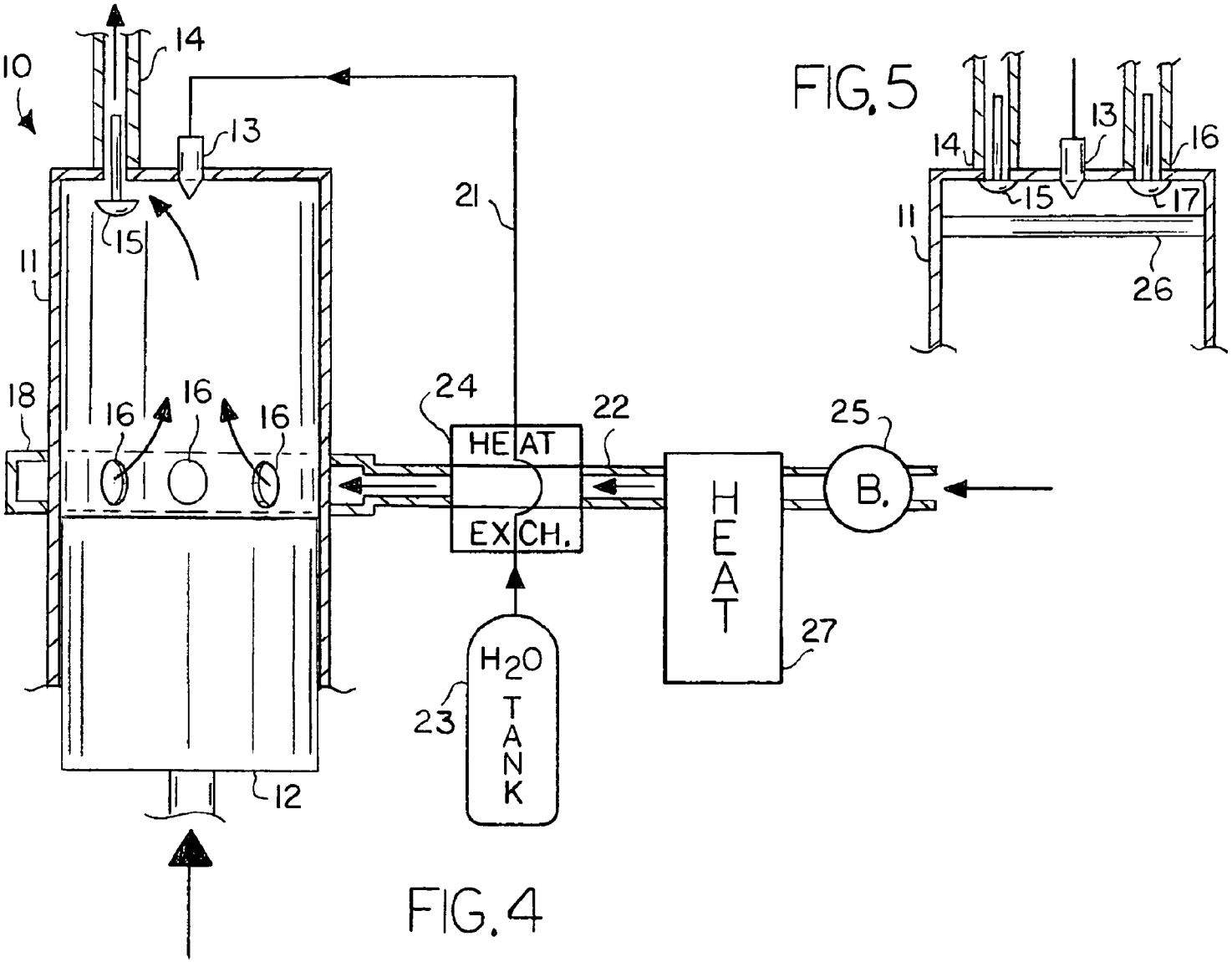
FIG. 4 is a representational view of an alternative embodiment of the steam powered engine, wherein the hot exhaust gas from a heat source is routed into scavenger ports exposed when the piston is at the bottom of the down stroke.
FIG. 5 is a representational view of a portion of an alternative embodiment of the steam powered engine, wherein a heating element is disposed within the cylinder.

An alternative embodiment is illustrated in FIG. 4. In this embodiment, the hot exhaust gas used to scavenge a portion of the gas and liquid out of the exhaust port 14 is introduced into the cylinder 11 through multiple scavenger ports 16 located in the side walls of the cylinder 11, the scavenger ports 16 being interconnected by an annular duct 18. The scavenger ports 16 are disposed such that they are exposed to the interior of the cylinder 11 by the piston 12 for only a short time during the down stroke, such that on the up stroke the scavenger ports 16 are sealed by the walls of the piston 12. As also shown in FIG. 4, hot gas production means 27 used for scavenging may be alternative heat sources to the secondary engine 20, such as for example a propane burner in conjunction with a blower 25. Operation of the embodiment of FIG. 4 is similar to that described in FIGS. 1 through 3. Upon flash expansion of the injected hot water, the piston 12 is driven downward in the cylinder 11, the exhaust valve 15 being closed during this step. As the piston 12 reaches the bottom of its stroke the scavenger ports 16 are exposed and hot exhaust gas from the secondary engine 20 enters the cylinder 11. Simultaneously, the exhaust valve 15 opens. As the pistons moves upward in the cylinder 11, the spent gas and liquid is driven through the exhaust port 14. The upward moving piston 12 seals off the scavenger ports 16 and continues to exhaust spent gas and liquid through the exhaust port 14 until the exhaust valve 15 closes. At this time the piston 12 compresses the hot gas remaining in the cylinder 11, creating an environment that results in flash expansion of the superheated water when it is introduced into the cylinder 11, thereby initiating a new cycle.

Figure 6:
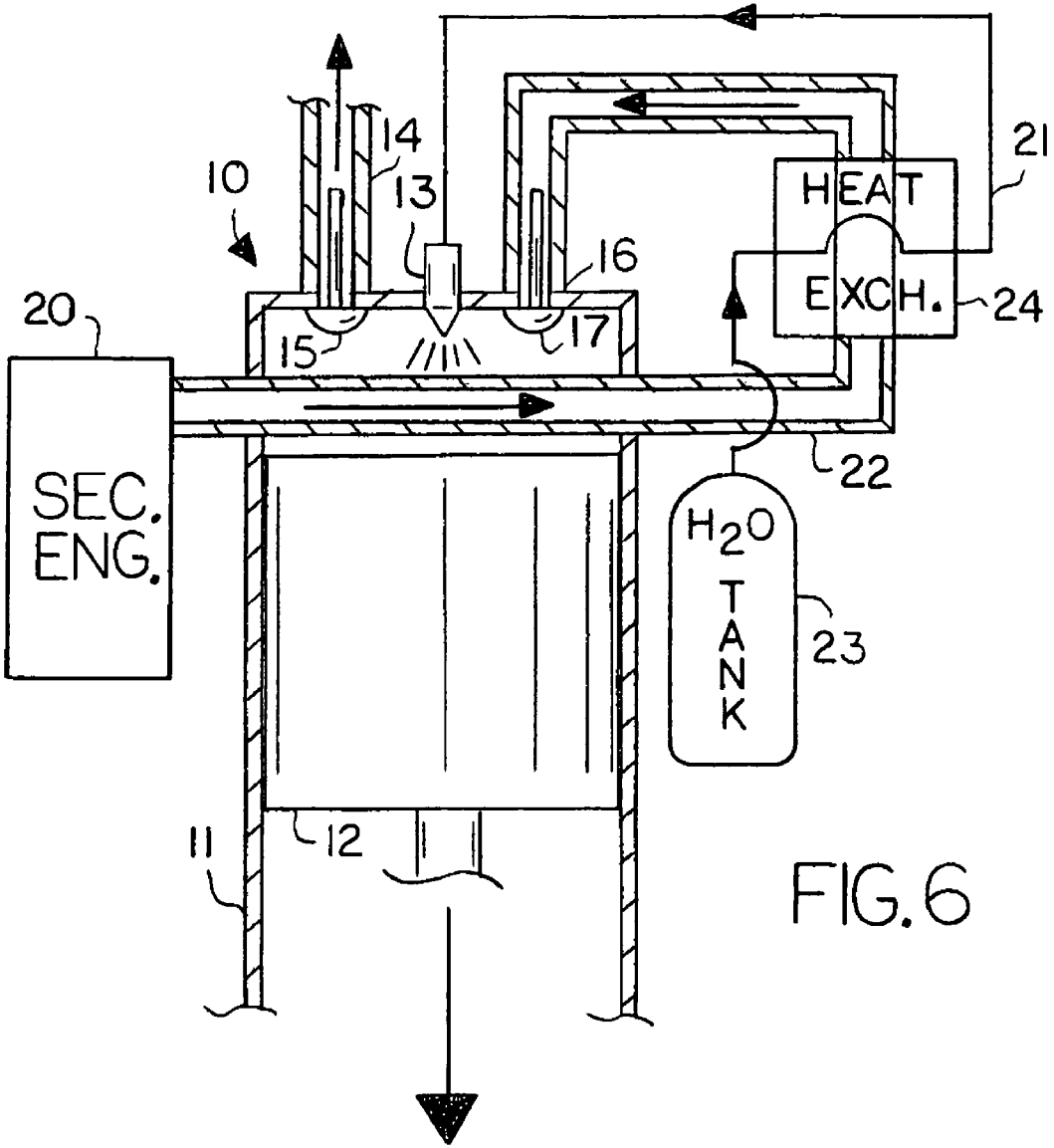
FIG. 6 is representational view of an alternative embodiment of the steam powered engine, wherein the hot exhaust gas is routed through the upper portion of the cylinder.

In FIG. 5, an alternative embodiment is shown wherein a heating element 26, such as an electrical resistance member, a glow plug or the like, is disposed within the upper portion of the cylinder 11 in order to maintain the compressed gas within the cylinder 11 at a high temperature. This same function can be accomplished in another alternative embodiment, as shown in FIG. 6, wherein the hot gas conduit 22 is routed through the interior of the cylinder 11 prior to its connection with the heat exchanger 24, such that heat is transferred from the conduit 22 into the cylinder 11.

I claim:

1. A steam powered engine system powering a drive shaft in a vehicle or equipment, said system comprising a main steam engine and a secondary combustion engine of lesser horsepower, said main steam engine comprising a cylinder having a side wall and a piston having a wall, said cylinder and said piston directly powering said drive shaft, said secondary combustion engine providing only hot exhaust gas to said main steam engine and being physically separated from said main steam engine such that said secondary combustion engine does not power said drive shaft;

a water tank containing water;

a heat exchanger wherein heat from said hot exhaust gas is transferred to said water;

hot gas conduit means to deliver said hot exhaust gas to said heat exchanger and to said cylinder;

water conduit means to deliver said water to said heat exchanger and to said cylinder;

an injection nozzle to inject said heated water into said cylinder, whereby said heated water flash expands into steam to drive said piston;

a scavenger port to allow passage of said hot exhaust gas into said cylinder;

an exhaust port to allow passage of gas and liquid from said cylinder; and an exhaust valve controlling passage of gas and liquid through said exhaust port.

2. The system of claim 1, further comprising a scavenger valve controlling passage of hot exhaust gas through said scavenger port.

3. The system of claim 1, further comprising blower means to move said hot exhaust gas through said hot gas conduit.

4. The system of claim 1, further comprising blower means to move said gas and liquid through said exhaust port.

5. The system of claim 1, wherein said scavenger port is disposed on said side wall of said cylinder such that said scavenger port is closed and opened by movement of said piston, said wall of said piston sealing said scavenger port when said scavenger port is closed.

6. The system of claim 5, further comprising plural scavenger ports connected by an annular duct.

7. The system of claim 1, further comprising a heating element disposed within said cylinder.

8. The system of claim 7, wherein said heating element is an electrical resistance member.

9. The system of claim 1, wherein said hot gas conduit passes through said cylinder.

10. A steam powered engine system comprising a main steam engine and a hot gas production means for producing hot gas, said hot gas production means being physically separated from said main steam engine, said main steam engine comprising a cylinder having a side wall and a piston having a wall;

a water tank containing water;

a heat exchanger wherein heat from said hot gas is transferred to said water;

hot gas conduit means to deliver said hot gas to said heat exchanger and to said cylinder;

water conduit means to deliver said water to said heat exchanger and to said cylinder;

an injection nozzle to inject said heated water into said cylinder, whereby said heated water flash expands into steam to drive said piston;

a scavenger port to allow passage of said hot gas into said cylinder;

an exhaust port to allow passage of gas and liquid from said cylinder; and an exhaust valve controlling passage of gas and liquid through said exhaust port.

11. The system of claim 10, further comprising a scavenger valve controlling passage of hot gas through said scavenger port.

12. The system of claim 10, further comprising blower means to move said hot gas through said hot gas conduit.

13. The system of claim 10, further comprising blower means to move said gas and liquid through said exhaust port.

14. The system of claim 10, wherein said scavenger port is disposed on said side wall of said cylinder such that said scavenger port is closed and opened by movement of said piston, said wall of said piston sealing said scavenger port when said scavenger port is closed.

15. The system of claim 14, further comprising plural scavenger ports connected by an annular duct.

16. The system of claim 10, further comprising a heating element disposed within said cylinder.

17. The system of claim 16, wherein said heating element is an electrical resistance member.

18. The system of claim 10, wherein said hot gas conduit passes through said cylinder.

19. The system of claim 10, wherein said hot gas production means comprises a propane burner.

20. A power system comprising:

a steam powered engine comprising at least one cylinder and piston combination powering a drive shaft;

a secondary combustion engine separate from said steam powered engine providing hot exhaust gas to said steam powered engine, said secondary combustion engine not powering said drive shaft;

a water tank containing water;

a heat exchanger wherein heat from said hot exhaust gas is transferred to said water;

hot gas conduit means to deliver said hot exhaust gas to said heat exchanger and to said cylinder;

water conduit means to deliver said water to said heat exchanger and to said cylinder;

an injection nozzle to inject said heated water into said cylinder, whereby said heated water flash expands into steam to drive said piston;

a scavenger port to allow passage of said hot exhaust gas into said cylinder;

an exhaust port to allow passage of gas and liquid from said cylinder; and an exhaust valve controlling passage of gas and liquid through said exhaust port.

* * * * *